US011609595B2

(12) United States Patent
Nakase et al.

(10) Patent No.: US 11,609,595 B2
(45) Date of Patent: Mar. 21, 2023

(54) MULTI-DIRECTIONAL INPUT DEVICE

(71) Applicant: Shenzhen Zesum Technology Co., Ltd., Shenzhen (CN)

(72) Inventors: Yusho Nakase, Shenzhen (CN); Shiying Yang, Shenzhen (CN); Chaoxian Chen, Shenzhen (CN)

(73) Assignee: Shenzhen Zesum Technology Co., Ltd., Shenzhen (CN)

( * ) Notice: Subject to any disclaimer, the term of this patent is extended or adjusted under 35 U.S.C. 154(b) by 138 days.

(21) Appl. No.: 17/232,645

(22) Filed: Apr. 16, 2021

(65) Prior Publication Data

US 2022/0155812 A1 May 19, 2022

(30) Foreign Application Priority Data

Nov. 19, 2020 (CN) ..... 202011305797.8

(51) Int. Cl.
*G05G 9/047* (2006.01)

(52) U.S. Cl.
CPC ..... *G05G 9/04796* (2013.01); *G05G 9/04737* (2013.01); *G05G 9/04792* (2013.01); *G05G 2009/04744* (2013.01)

(58) Field of Classification Search
CPC ..... G05G 9/04796; G05G 9/04737; G05G 9/04792–2009/04744
See application file for complete search history.

(56) References Cited

U.S. PATENT DOCUMENTS

| | | | | |
|---|---|---|---|---|
| 4,673,778 | A * | 6/1987 | Lewandowski | H01H 11/00 200/332 |
| 10,573,473 | B2 * | 2/2020 | Wu | A63F 13/24 |
| 2022/0155810 | A1 * | 5/2022 | Nakase | G05G 9/047 |
| 2022/0155811 | A1 * | 5/2022 | Nakase | G05G 9/047 |

FOREIGN PATENT DOCUMENTS

| | | | |
|---|---|---|---|
| CN | 100587648 | C | 2/2010 |
| JP | S53142520 | A | 12/1978 |
| JP | H10199357 | A | 7/1998 |
| JP | 2004207040 | A | 7/2004 |
| JP | 3698565 | B2 | 9/2005 |
| TW | M361670 | U | 7/2009 |

OTHER PUBLICATIONS

Office Action issued in counterpart Japanese Patent Application No. 2020-197773, dated Nov. 30, 2021.
Office Action issued in counterpart Taiwanese Patent Application No. 109141800, dated Feb. 25, 2022.

* cited by examiner

*Primary Examiner* — Vanessa Girardi
(74) *Attorney, Agent, or Firm* — Westbridge IP LLC

(57) ABSTRACT

Disclosed is a multi-directional input device, including a pressing switch. Each of two opposite side surfaces of the pressing switch is provided with a first protrusion. The base includes two base side surfaces respectively opposite to the two opposite side surfaces of the pressing switch. Each of the two opposite base side surfaces is provided with a second protrusion respectively, and the second protrusion is engaged with the first protrusion to fix the pressing switch.

2 Claims, 7 Drawing Sheets

MULTI-DIRECTIONAL INPUT DEVICE

CROSS REFERENCE TO RELATED APPLICATIONS

The present disclosure claims the priority of Chinese Patent Application No. 202011305797.8, filed on Nov. 19, 2020 and entitled "Multi-directional Input Device", which is hereby incorporated by reference in its entirety.

TECHNICAL FIELD

The present disclosure relates to the technical field of input devices, in particular to a multi-directional input device.

BACKGROUND

A multi-directional input device generally includes a cover, an operator rotatably arranged in the cover, two rocker arms that rotate with pivoting of the operator, and a detection device that detects rotating amount of the rocker arms and outputs a corresponding signal according to the rotating amount of the rocker arms. In order to input a signal through pressing the operator, the cover may further be provided with a pressing switch which may be triggered when the operator is driven. However, in the related art, the pressing switch of the multi-directional input device is locked and fixed by a plurality of screws, so that the plurality of screws need to be aligned with and screwed in or out of the screw holes when the pressing switch is disassembled and assembled. Due to the complexity of the process, the installation efficiency of the pressing switch is reduced.

SUMMARY

The main purpose of the present disclosure is to provide a multi-directional input device, which aims to simplify the installation process of a pressing switch of the multi-directional input device and improve the installation efficiency of the pressing switch.

To achieve the above purpose, the present disclosure provides a multi-directional input device including:

a cover defining an opening;

a pivotable operator protruding upward from the opening;

a first rocker arm and a second rocker arm rotating with pivoting of the operator, rotating axes of the first rocker arm and the second rocker arm being perpendicular to each other;

a first rotary electrical component and a second rotary electrical component respectively detecting rotation of the first rocker arm and rotation of the second rocker arm;

a square pressing switch controlling electrical switching action through a pressing operation of the operator;

a base fixing the pressing switch and the cover; where:

each of two opposite side surfaces of the pressing switch is provided with a first protrusion, the base includes two base side surfaces respectively opposite to the two opposite side surfaces of the pressing switch, each of the two base side surfaces is provided with a second protrusion respectively, and the second protrusion is engaged with the first protrusion to fix the pressing switch.

In an embodiment of the present disclosure, surfaces of the first protrusion and the second protrusion that are correspondingly engaged are both inclined surfaces.

In an embodiment of the present disclosure, an interference between the second protrusion and the first protrusion is maximum at a center of an interference range therebetween, and the first protrusion is hung on both sides of the interference range to reduce interference.

According to the multi-directional input device of the technical solution of the present disclosure, the pressing switch is provided with the first protrusions, and the base is provided with the second protrusions, and each first protrusion and the corresponding second protrusion are engaged to fix the pressing switch. Compared with the complicated installation process of the pressing switch of the multi-directional input device in the related art, the pressing switch in this solution only needs to be pressed when it is installed to make the first protrusion to be engaged with the second protrusion. This simplifies the installation process of the pressing switch, thereby improving the installation efficiency of the pressing switch. In addition, since the first protrusions and the second protrusions are respectively located on opposite sides, the snapping force on the opposite sides of the pressing switch is equal, so as to ensure that the pressing switch is uniformly stressed everywhere and is more stable and fixed to the base.

BRIEF DESCRIPTION OF THE DRAWINGS

In order to more clearly explain the embodiments of the present disclosure or the technical solutions in the prior art, the drawings used in the description of the embodiments or the prior art will be briefly introduced below. Obviously, the drawings in the following description are merely some embodiments of the present disclosure. For those of ordinary skill in the art, other drawings can be obtained based on the structure shown in these drawings without paying creative work.

Figure 1:
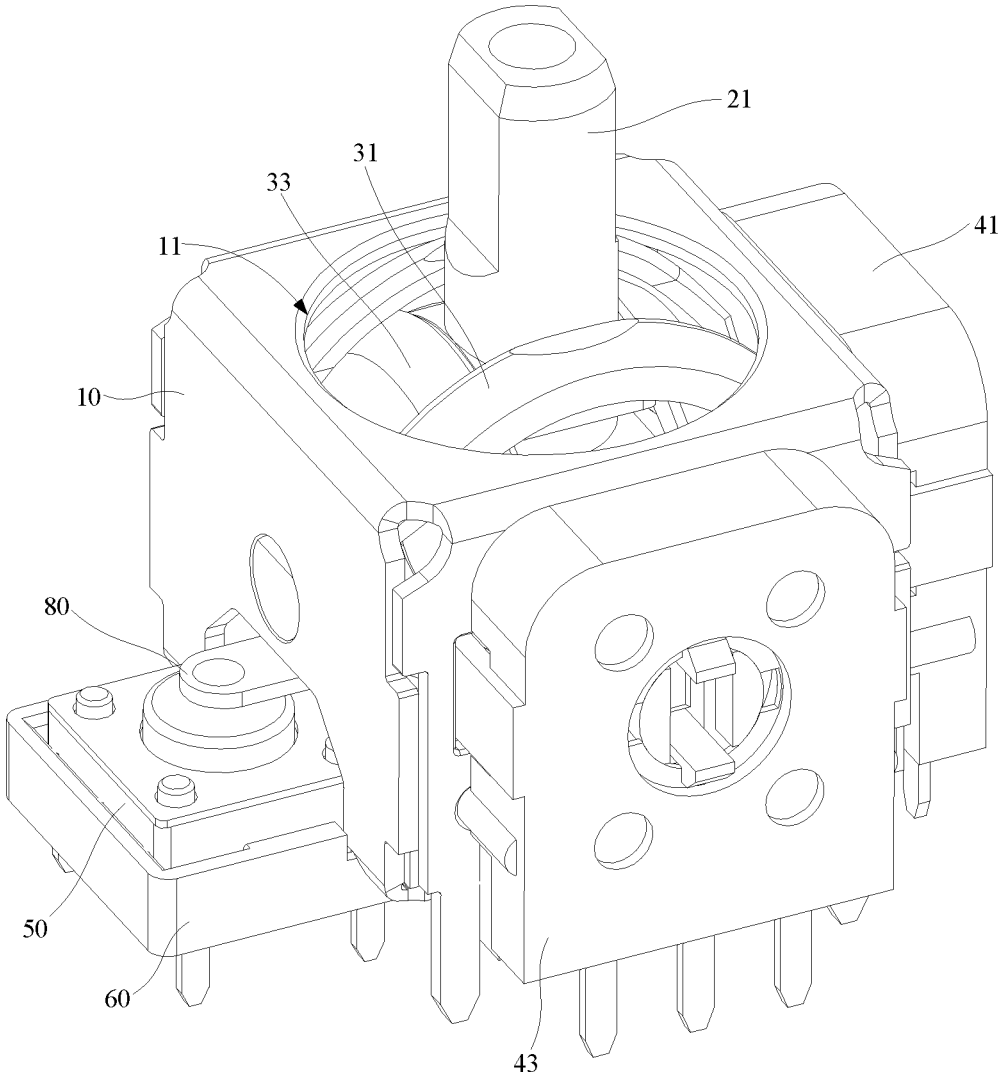
FIG. 1 is a schematic assembly view of a multi-directional input device according to an embodiment of the present disclosure.
Figure 2:
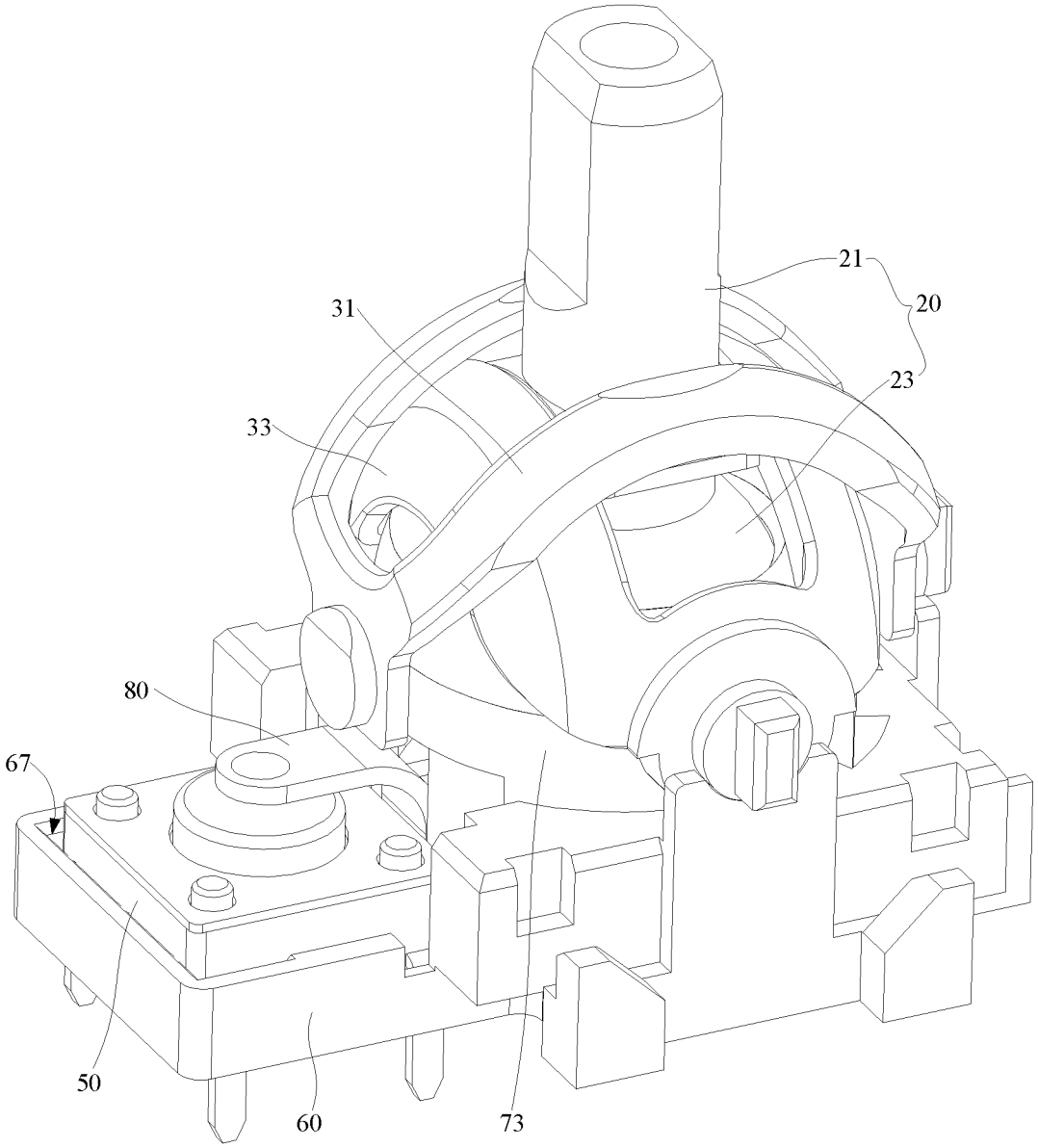
FIG. 2 is a schematic structural view of the multi-directional input device in FIG. 1 with a cover removed.

The realization of the objects, functional characteristics and advantages of this disclosure will be further described in conjunction with the embodiments and with reference to the drawings.

DETAILED DESCRIPTION OF THE EMBODIMENTS

In the following, the technical solutions in the embodiments of the present disclosure will be clearly and completely described with reference to the drawings in the embodiments of the present disclosure. Obviously, the described embodiments are only a part of the embodiments of the present disclosure, but not all of the embodiments. Based on the embodiments of the present disclosure, all other embodiments obtained by those of ordinary skill in the art without creative efforts shall fall within the claimed scope of the present disclosure.

It should be noted that all directional indicators (such as up, down, left, right, front, back, etc.) in the embodiments of the present disclosure are only used to explain the relative positional relationship, movement situation, etc. between components in a specific posture (as shown in the drawings). If the specific posture changes, the directional indication also changes accordingly.

In the present disclosure, unless otherwise clearly specified and limited, the terms "connected", "fixed", etc. should be understood in a broad sense. For example, "fixed" can be a fixed connection, a detachable connection, or a whole; it can be a mechanical connection or an electrical connection; it can be a direct connection or an indirect connection through an intermediary, and it can be the internal communication between two components or the interaction relationship between two components, unless specifically defined otherwise. For those of ordinary skill in the art, the specific meanings of the above terms in the present disclosure can be understood according to specific circumstances.

In addition, the descriptions related to "first", "second", and the like in the present disclosure are for descriptive purposes only, and cannot be understood as indicating or implying their relative importance or implicitly indicating the number of technical features indicated. Therefore, the features defined with "first" and "second" may explicitly or implicitly include at least one of the features. In addition, the technical solutions between the various embodiments can be combined with each other, but they must be based on what can be achieved by those of ordinary skill in the art. When the combination of technical solutions is contradictory or cannot be achieved, it should be considered that such a combination of technical solutions does not exist, nor within the protection scope of the present disclosure.

The present disclosure provides a multi-directional input device.

Referring to FIGS. 1, 2, 3 and 4, in an embodiment of the present disclosure, the multi-directional input device includes a cover 10, an operator 20, a first rocker arm 31, a second rocker arm 33, a first rotary electrical component 41, a second rotary electrical component 43, a pressing switch 50, and a base 60. The cover 10 defines an opening 11. The operator 20 is pivotable and protrudes upward from the opening 11. The first rocker arm 31 and the second rocker arm 33 rotates with pivoting of the operator 20, and rotating axes of the first rocker arm 31 and the second rocker arm 33 are perpendicular to each other. The first rotary electrical component 41 and the second rotary electrical component 43 respectively detects rotation of the first rocker arm 31 and rotation of the second rocker arm 33. The pressing switch 50 is square and controls electrical switching action through a pressing operation of the operator 20. The base 60 fixes the pressing switch 50 and the cover 10. Each of two opposite side surfaces 51 of the pressing switch 50 is provided with a first protrusion 53. The base 60 includes two base side surfaces 61 respectively opposite to the two opposite side surfaces 51 of the pressing switch 50. Each of the two opposite base side surfaces 61 is provided with a second protrusion 63, and the second protrusion 63 is engaged with the first protrusion 53 to fix the pressing switch 50.

In an embodiment of the present disclosure, the cover 10 can be mainly configured to shield the first rocker arm 31, the second rocker arm 33 and part of the operator 20 (that is, the first rocker arm 31 and the second rocker arm 33 can be arranged inside the cover 10 and distributed at intervals in the up-down direction), so as to reduce the possibility of damage by foreign objects, which is beneficial to extend the service life of the multi-directional input device. A projection of the cover 10 on a horizontal plane may be roughly square shape. Specifically, the cover 10 may include a bottom wall and a side wall. The bottom wall and the base 60 are oppositely arranged, and the bottom wall defines an opening 11. The side wall is arranged around a periphery of the bottom wall and is extended in a direction facing the base 60, and an end of the side wall away from the bottom wall is connected to the base 60. In order to facilitate the repair and replacement of the parts located inside the cover 10, the side wall of the cover 10 may be detachably connected to the base 60, specifically may be connected by screws, buckle connection or magnetic fixation, etc., so as to simplify the disassembly and assembly process of the cover 10. Certainly, the present disclosure is not limited thereto. In other embodiments, the cover 10 may be fixedly connected to the base 60.

The operator 20 may be mainly configured for the user to drive and perform the corresponding pivot action to realize the input of the corresponding action signal. For example, by driving the operator 20 to pivot forward, backward, left, or right, the corresponding forward, backward, left, or right action signals are input. Referring to FIGS. 1, 2, 6 and 7, the operator 20 may include an operating part 21 and an upper hemisphere 23 connected to a lower end of the operating part 21. The operating part 21 penetrates through the first rocker arm 31 and the second rocker arm 33, and penetrates from the opening 11 of the cover 10 to the outside. The upper hemisphere 23 is hemispherical and has a diameter greater than a diameter of the operating part 21. A surface of the upper hemisphere 23 facing away from the operating part 21 is formed as a hemispherical plane part 25, and a lower hemisphere 27 is protruded from the hemispherical plane part 25. Spherical centers of the lower hemisphere 27 and the upper hemisphere 23 coincide, and a diameter of the lower hemisphere 27 is smaller than a diameter of the upper hemisphere 23.

At this time, the multi-directional input device may further include a lower support 71 and a substantially cylindrical upper support 73. The lower support 71 is arranged on the base 60 and located inside the cover 10. The lower support 71 includes a hemispherical concave 711 at an upper end, and the hemispherical concave 711 abuts against and supports the lower hemisphere 27. The upper support 73 is located inside the cover 10, and covers outside of the lower support 71. The upper support 73 defines a hemispherical hole 731 at a position corresponding to the opening 11. The upper support 73 further defines a through hole 733 communicated to the upper hemispherical hole 731 above the hemispherical hole 731, and a diameter of the through hole 733 is greater than the diameter of the operating part 21. A part of the upper hemisphere is abutted against a hole wall of the hemispherical hole 731, and another part of the upper hemisphere is protruded from the through hole 733. In this way, the hole wall of the hemispherical hole 731 of the upper support 73 abuts against the upper hemisphere 23, and the upper end of the lower support 71 abuts against the lower hemisphere 27, so as to realize a spherical rotational fit of the operator 20, that is, the operator 20 may be rotated arbitrarily in the direction of 360°.

Certainly, it should be noted that the present disclosure is not limited thereto. In other embodiments, the operator 20 may also be provided with a rotating section below the operating part 21. One end of the rotating section is rotatably connected to the operating part 21, the other end of the rotating section is rotatably connected to the base 60, and a rotating axis of the rotating section and the operating part 21 is perpendicular to a rotating axis of the rotating section and the base 60, that is, one of which is parallel to the rotating axis of the first rocker arm 31, and the other one of which is parallel to the rotating axis of the second rocker arm 33.

The first rocker arm 31 and the second rocker arm 33 can be mainly configured for driving the operating part 21 of the operator 20 to rotate accordingly, and rotating amounts of the first rocker arm 31 and the second rocker arm 33 are respectively detected by the first rotary electric component 41 and the second rotary electric component 43, so as to output corresponding signals according to rotating amounts. Defining an X direction and a Y direction perpendicular to each other on the horizontal plane, the rotating axis of the first rocker arm 31 may be along one of the X direction and the Y direction, and the rotating axis of the second rocker arm 33 may be along the other one of the X direction and the Y direction. The first rocker arm 31 and the second rocker arm 33 are located above the upper support 73. The first rotary electrical component 41 and the second rotary electrical component 43 may be mainly configured for detecting the rotating amounts of the first rocker arm 31 and the second rocker arm 33, therefore, since the working principle of which is already known, it will not be detailed here. The first rotary electrical component 41 may be arranged on the outside of the cover 10 and connected to the first rocker arm 31; and the second rotary electrical component 43 may also be arranged on the outside of the cover 10 and connected to the second rocker arm 33.

The pressing switch 50 can be mainly configured to be pressed against and triggered when the operator 20 is pressed, and control electrical switching action. The working principle of the pressing switch 50 is the already known, so it will not be described in detail here. The pressing switch 50 can be triggered by being directly pressed against by the operator 20, or can be triggered by being indirectly pressed against by the operator 20. For example, a pressing bracket 80 can be provided, one end of the pressing bracket 80 is located between the operator 20 and the base 60, and the other end of the pressing bracket 80 is located above the pressing switch 50, so that the pressing bracket 80 can deform downward when pressed by the operator 20 and abut against the pressing switch 50. When a lower support 71 is provided, the lower support 71 is configured to be liftable relative to the base 60, and the pressing bracket 80 can be located below the lower support 71, so as to be pressed when the lower support 71 is lowered under the drive of the operator 20. The base 60 may be mainly configured to fix parts such as the cover 10, the lower support 71 and the upper support 73, and play a bearing and supporting role.

According to the multi-directional input device of the technical solution of the present disclosure, the pressing switch 50 is provided with first protrusions 53, and the base 60 is provided with second protrusions 63, and the first protrusion 53 and the corresponding second protrusion 63 are engaged to fix the pressing switch 50. Compared with the complicated installation process of the pressing switch 50 of the multi-directional input device in the related art, the pressing switch 50 in this solution only needs to be pressed when it is installed to make the first protrusion 53 snap into the second protrusion 63. This simplifies the installation process of the pressing switch 50, thereby improving the installation efficiency of the pressing switch 50. In addition, since the first protrusions 53 and the second protrusions 63 are respectively located on opposite sides, the snapping force on the opposite sides of the pressing switch 50 is equal, so as to ensure that the pressing switch 50 is uniformly stressed everywhere and is more stable and fixed to the base 60.

Figure 3:
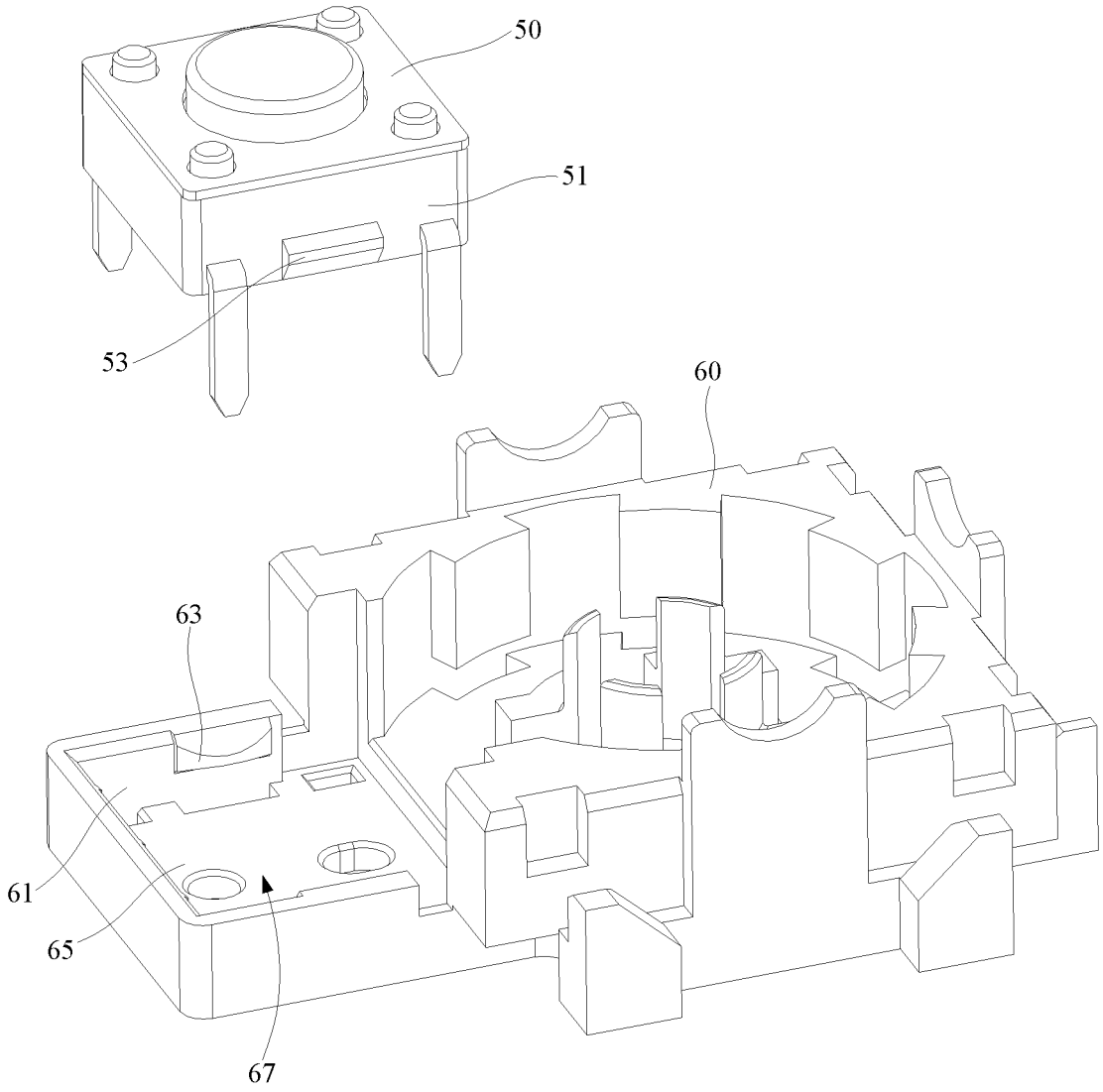
FIG. 3 is a schematic exploded view of a pressing switch and a base of the multi-directional input device in FIG. 1.
Figure 4:
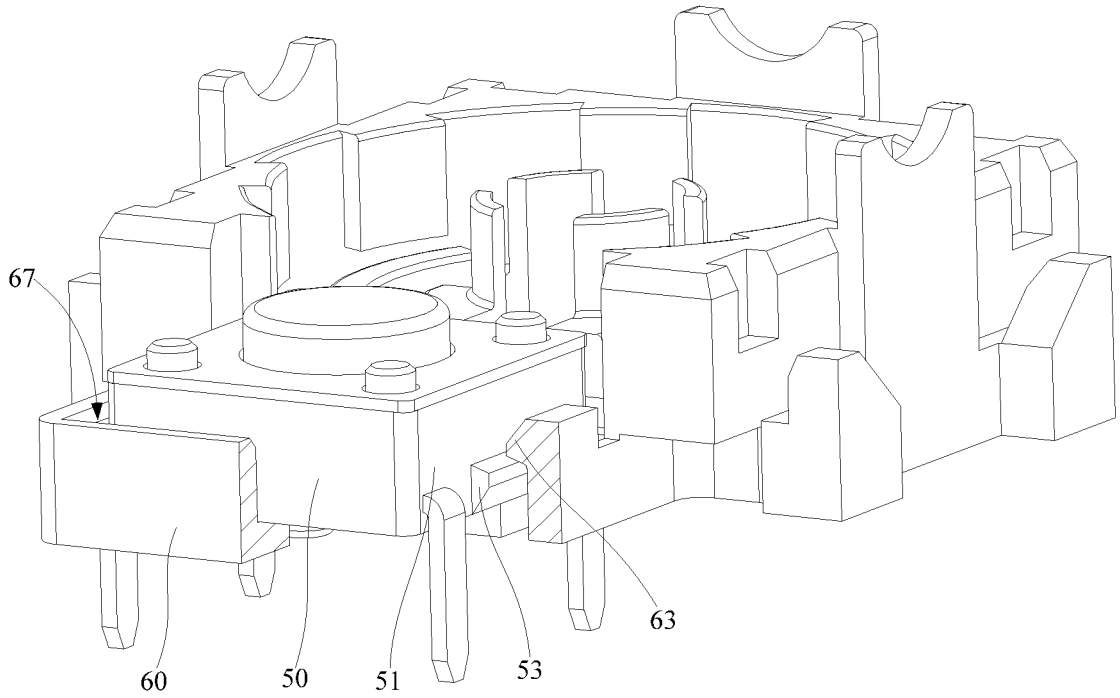
FIG. 4 is a schematic assembly view of the pressing switch and the base of the multi-directional input device in FIG. 1.

Referring to FIG. 3 and FIG. 4, in an embodiment of the present disclosure, surfaces of the first protrusion 53 and the second protrusion 63 that are correspondingly engaged are both inclined surfaces.

It can be understood that the surfaces of the first protrusion 53 and the second protrusion 63 that are correspondingly engaged are inclined surfaces, which can make the first protrusion 53 and the second protrusion 63 abut more closely, in addition, the abutting area may be larger, which reduces the possibility of loosening of the pressing switch 50 in the up-down direction, thereby further improving the stability of the installation of the pressing switch 50. The surfaces the first protrusion 53 and the second protrusion 63 that are correspondingly engaged refer to an upper surface of the first protrusion 53 and a lower surface of the second protrusion 63. In addition, it should be noted that, the present disclosure is not limited thereto, and in other embodiments, the surfaces the first protrusion 53 and the second protrusion 63 that are correspondingly engaged may be flat.

In an embodiment of the present disclosure, an interference between the second protrusion 63 and the first protrusion 53 is maximum at a center of an interference range therebetween, and the first protrusion 53 is hung on both sides of the interference range to reduce interference.

Figure 5:
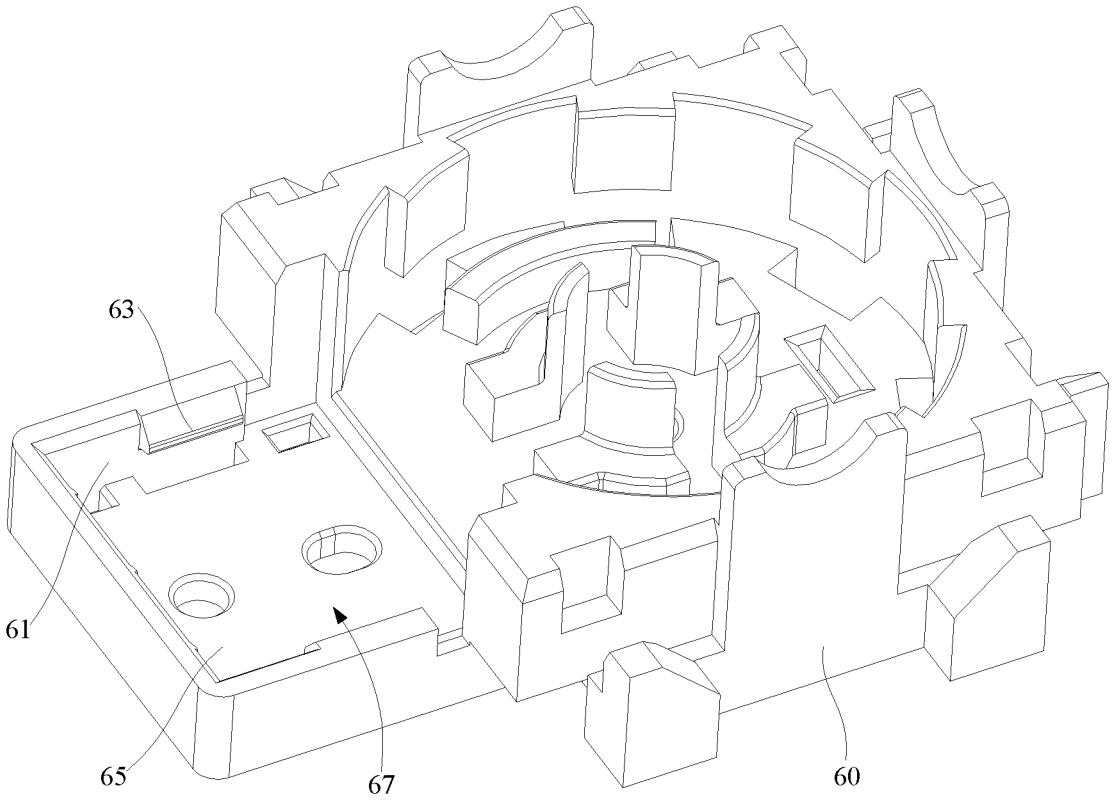
FIG. 5 is a schematic structural view of the base of the multi-directional input device in FIG. 1 according to another embodiment.
Figure 6:
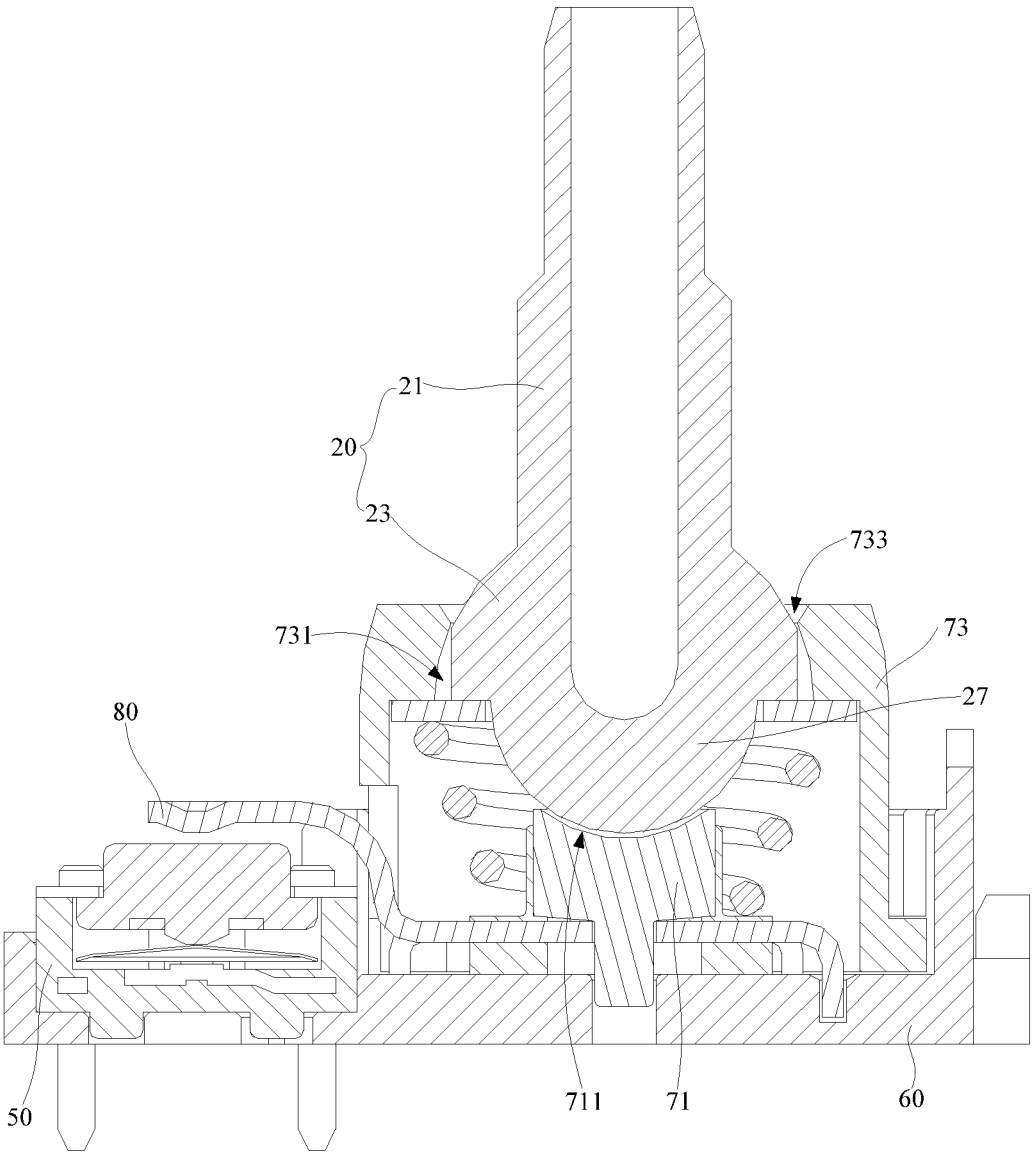
FIG. 6 is a cross-sectional view of a partial structure of the multi-directional input device in FIG. 1.
Figure 7:
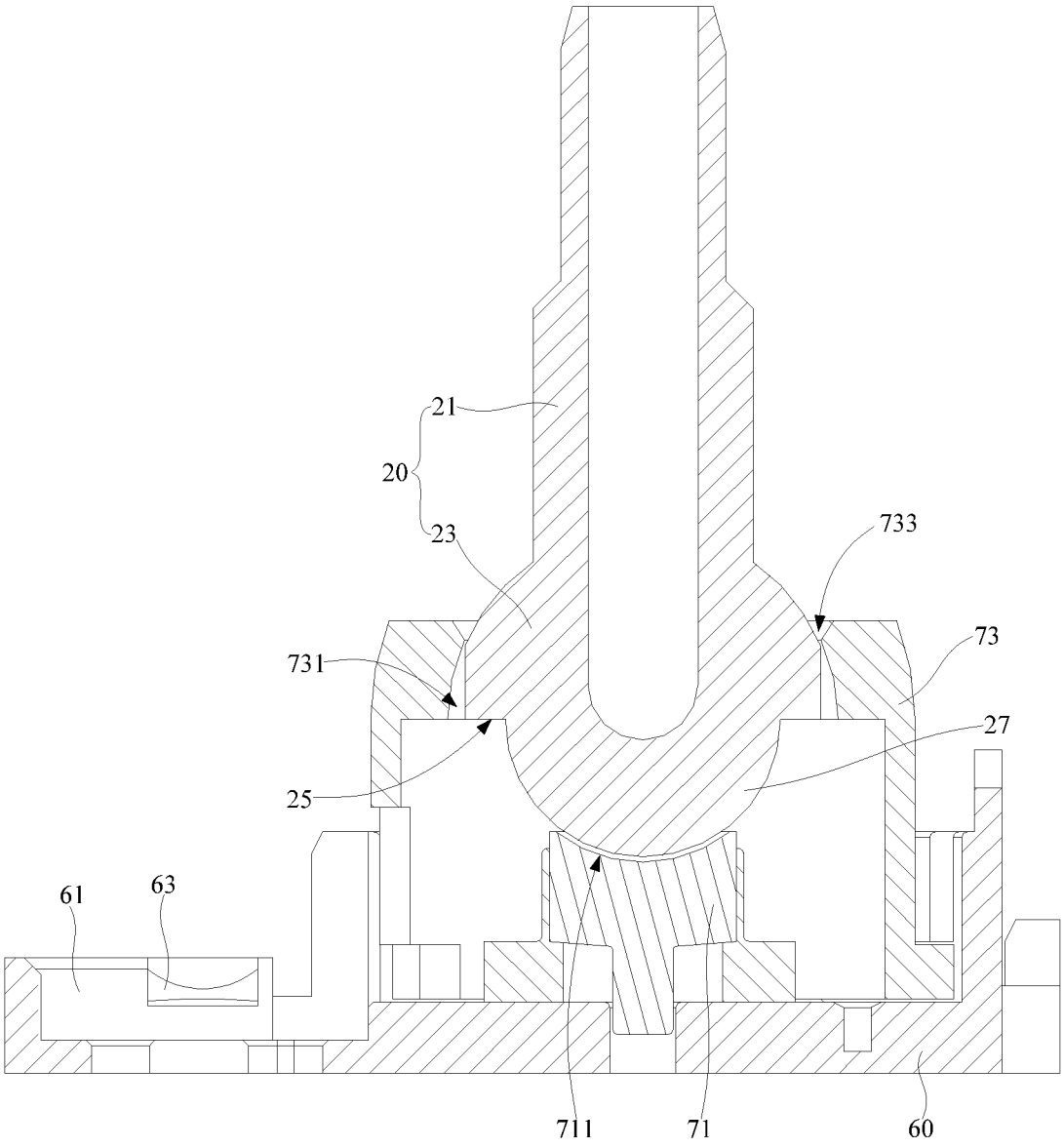
FIG. 7 is a cross-sectional view of another partial structure of the multi-directional input device in FIG. 1.

It can be understood that the interference between the second protrusion 63 and the first protrusion 53 is maximum at the center of the interference range, and gradually decreases to both sides (that is, on the horizontal projection plane, the second protrusion 63 is a convex arc structure). In this way, when the first protrusion 53 is engaged with the second protrusion 63, it is possible to reduce the amount of deformation of the base 60 at the portion where the base side surface 61 is formed. At this time, the first protrusion 53 can be smoothly engaged with the second protrusion 63, thereby further improving the installation efficiency of the pressing switch 50. Certainly, it should be noted that, the present disclosure is not limited thereto, and in other embodiments, please refer to FIG. 5, on the horizontal projection plane, the second protrusion 63 may also be a linear segment structure.

Referring to FIG. 3 and FIG. 4, in an embodiment of the present disclosure, the base 60 includes a base bottom surface 65 connected to the base side surfaces 61. The base bottom surface 65 and the base side surfaces 61 are enclosed to define an accommodating part 67, and at least part of the pressing switch 50 is embedded in the accommodating part 67.

It can be understood that the setting of the accommodating part 67 gives the pressing switch 50 a certain installation space, which can make the pressing switch 50 more compact to be installed on the base 60, therefore, it is beneficial to reduce the overall volume of the multi-directional input device and make it easy to manage and carry. At the same time, the accommodating part 67 can play a certain limit role to the peripheral side of the pressing switch 50, so that the possibility of movement of the pressing switch 50 in the front-rear or left-right direction on the base 60 is reduced, thereby further improving the stability of the installation of the pressing switch 50.

The above is only preferable embodiments of the present disclosure, and thus does not limit the scope of the present disclosure, and the equivalent structural transformation made by the content of the specification and the drawings of the present disclosure, or directly/indirectly applied to other related technical fields are all included in the patent protection scope of the present disclosure.

What is claimed is:

1. A multi-directional input device, comprising:

a cover defining an opening;

a pivotable operator protruding upward from the opening;

a first rocker arm and a second rocker arm rotating with pivoting of the operator, rotating axes of the first rocker arm and the second rocker arm being perpendicular to each other;

a first rotary electrical component and a second rotary electrical component respectively detecting rotation of the first rocker arm and rotation of the second rocker arm;

a square pressing switch controlling electrical switching action through a pressing operation of the operator; and a base fixing the pressing switch and the cover; wherein:

each of two opposite side surfaces of the pressing switch is provided with a first protrusion, the base comprises two base side surfaces respectively opposite to the two opposite side surfaces of the pressing switch, each of the two base side surfaces is provided with a second protrusion respectively, and the second protrusion is engaged with the first protrusion to fix the pressing switch, wherein an interference between the second protrusion and the first protrusion is maximum at a center of an interference range therebetween, and gradually decreases to both sides, to reduce an amount of deformation of the base given the second protrusion is a convex arc.

2. The multi-directional input device of claim 1, wherein surfaces of the first protrusion and the second protrusion that are correspondingly engaged are both inclined surfaces.

* * * * *